US005200739A

United States Patent [19]

Eland

[11] Patent Number: 5,200,739

[45] Date of Patent: Apr. 6, 1993

[54] CHARACTER GENERATOR FOR DISPLAYING CHARACTERS WITH A SHADOW ON A DISPLAY SCREEN

[75] Inventor: Rudolf Eland, Eindhoven, Netherlands

[73] Assignee: U.S. Philips Corporation, New York, N.Y.

[21] Appl. No.: 919,508

[22] Filed: Jul. 24, 1992

Related U.S. Application Data

[63] Continuation of Ser. No. 839,013, Feb. 18, 1992, abandoned, which is a continuation of Ser. No. 505,207, Apr. 4, 1990, abandoned.

[30] Foreign Application Priority Data

Apr. 20, 1989 [NL] Netherlands ..... 8900988

[51] Int. Cl.[5] ..... G09G 1/06

[52] U.S. Cl. ..... 340/730; 340/703; 340/723

[58] Field of Search ..... 340/703, 723, 729, 730, 340/731, 733, 735, 748, 790

[56] References Cited

U.S. PATENT DOCUMENTS 3,918,039 4/1975 Clark ..... 340/711
4,186,393 1/1980 Leventer ..... 340/748
4,408,198 10/1983 Kudirka ..... 340/748
4,794,451 12/1988 Suzuki et al. ..... 340/730
5,003,303 3/1991 Kellar et al. ..... 340/730

*Primary Examiner*—Jeffery A. Brier
*Assistant Examiner*—Jick Chin
*Attorney, Agent, or Firm*—Michael E. Marion

[57] ABSTRACT

Character generator which provides the displayed characters, when displayed simultaneously with a video picture, with a shadow in a complimentary or programmable color so that the readability is optimum under all circumstances without any unnecessary blanking of the video picture. To this end the character generator (43) is adapted to alternately address both the pixel to be displayed and at least one adjacent pixel in a character memory (171). A blanking signal (FBL), which blanks the received video picture dependent on both the pixel to be displayed and the adjacent pixel, is generated in a blanking circuit (20). While the video picture is being blanked, the characters are displayed in a foreground color and the shadow is displayed in a background color. The invention is applicable in television receivers, camera recorders and the like, using a character generator for displaying locally generated operating information (On Screen Display) or information supplied by an external source (Teletext).

11 Claims, 6 Drawing Sheets

CHARACTER GENERATOR FOR DISPLAYING CHARACTERS WITH A SHADOW ON A DISPLAY SCREEN

This is a continuation of application Ser. No. 07/839,013, filed on Feb. 18, 1992, now abandoned which is a continuation of prior application Ser. No. 07/505,207, filed on Apr. 4, 1990, now abandoned.

1. BACKGROUND OF THE INVENTION

1.1 Field of the Invention

The invention relates to a character generator for displaying alphanumerical and graphic characters on a display screen, which characters are displayed simultaneously with a video picture. Such a character generator is used, for example, in television receivers for displaying operating information (On Screen Display) and for displaying information which is supplied in an encoded form by an external source (Teletext). These character generators are also used in video cameras and camera recorders for making titles and the like, and in Compact Disc players for displaying Compact Disc-recorded data.

1.2 Description of the Prior Art

A character generator for displaying characters on a display screen generally comprises a page memory for storing the character codes of the characters to be displayed. Such a character code consists of, for example, a 7-bit number which is assigned to a character in accordance with a standardized table. The character codes are applied to a pixel generator in which each character is fixed in the form of a number of pixels, for example 6 pixels horizontally and 10 pixels vertically, and which generates a color selection bit for each pixel. The successively generated color selection bits are applied to a selector with which a foreground color signal or a background color signal is selected. In this way a color is assigned to each pixel of a character, the pixels in the foreground color determining the shape of the symbol to be displayed on the display screen. For alpha-numerical symbols such as figures, letters and punctuation marks the pixel generator comprises a memory in which a matrix of n*m, in this example 6*10, color selection bits are stored for each character. For simple graphic symbols the pixel generator further often comprises a logic network which derives the color selection bits directly from the character code.

The foreground color and the background color may be fixed colors, for example black and white. They can also be programmed for each page, each row or even each character. Particularly the way in which colors in the character generator of a teletext decoder are generated may be mentioned: in fact, some of the 7bit character codes are reserved for defining a color which remains valid until the end of the row or until a new color is defined in an identical way.

A character generator further comprises means for generating a blanking signal having a value defined for each pixel, intended for blanking the normal picture signal on the display screen in order to display the generated character signal on this screen. If the picture signal is to be blanked completely, such as, for example when displaying teletext pages, the blanking signal is generated continuously. However, a video picture and a text generated by the character generator must often be displayed simultaneously. This is the case, for example, if a TV program is subtitled by means of teletext, or if operating information such as a program or channel number generated in the receiver is displayed.

Two methods are known for simultaneously displaying a picture signal and text generated by the character generator. The first method is to blank the picture signal during a "box" comprising one or more rows or parts thereof in which the characters are displayed in a foreground color as well as a background color. In this so-called "boxed" mode the readability is ensured if the two colors are sensibly chosen, but the blanking signal blanks a relevant portion of the video picture. The second method is to blank the picture signal only during the pixels which are displayed in the foreground color in response to the corresponding color selection bit. In this so-called "mixed" mode the visibility of the alphanumerical or graphic symbols is very much dependent on color and brightness differences between the characters and the video picture in the background.

2. SUMMARY OF THE INVENTION

It is an object of the invention to realize, inter alia, a character generator for displaying characters on a display screen with an improved readability when they are simultaneously displayed with a video picture, without any unnecessary blanking of this video picture.

According to the invention the actual value of the blanking signal is to this end dependent on both the color selection bit of the actual pixel and on the color selection bit of at least one predetermined adjacent pixel. More particularly, the picture signal is now not only blanked during a pixel which is displayed in the foreground color. The picture signal is also blanked while the actual pixel is being displayed in the background color if the foreground color is assigned to the adjacent pixel. The actual pixel in the background color is then, as it were, the shadow of this adjacent pixel in the foreground color.

Its effect on the display screen is that the displayed characters are provided with a shadow. The position of the shadow is dependent on the choice of the adjacent pixel. For example, a shadow may be displayed to the left, right, above or below the original character. A plurality of shadows can also be combined by selecting a plurality of adjacent pixels. It is particularly possible to give a character a complete contour in a contrasting color in this way.

The displayed characters are clearly visible against any video picture in the background if two contrasting colors are chosen for the foreground color and the background color. A very useful embodiment of the character generator according to the invention is obtained if used in a teletext decoder, where f.color and b.color are defined by an external source, as a replacement for the "boxed"-mode. When displaying, for example, subtitles, only the most necessary portion of the video picture is blanked, while the functional character of foreground and background colors, which is often specific of subtitles, is maintained. This leads to a considerable improvement as compared with existing teletext decoders in which the subtitles are displayed within a given "box" determined by the source and in which the video picture is blanked during this entire "box".

3. DESCRIPTION OF EMBODIMENTS

3.1 Brief Description of the Figures

Embodiments of the invention will now be described in greater detail with reference to the accompanying drawings in which FIG. 1 shows diagrammatically the structure of a television receiver with a teletext decoder;

3.2 General Structure of a Television Receiver

Figure 1:
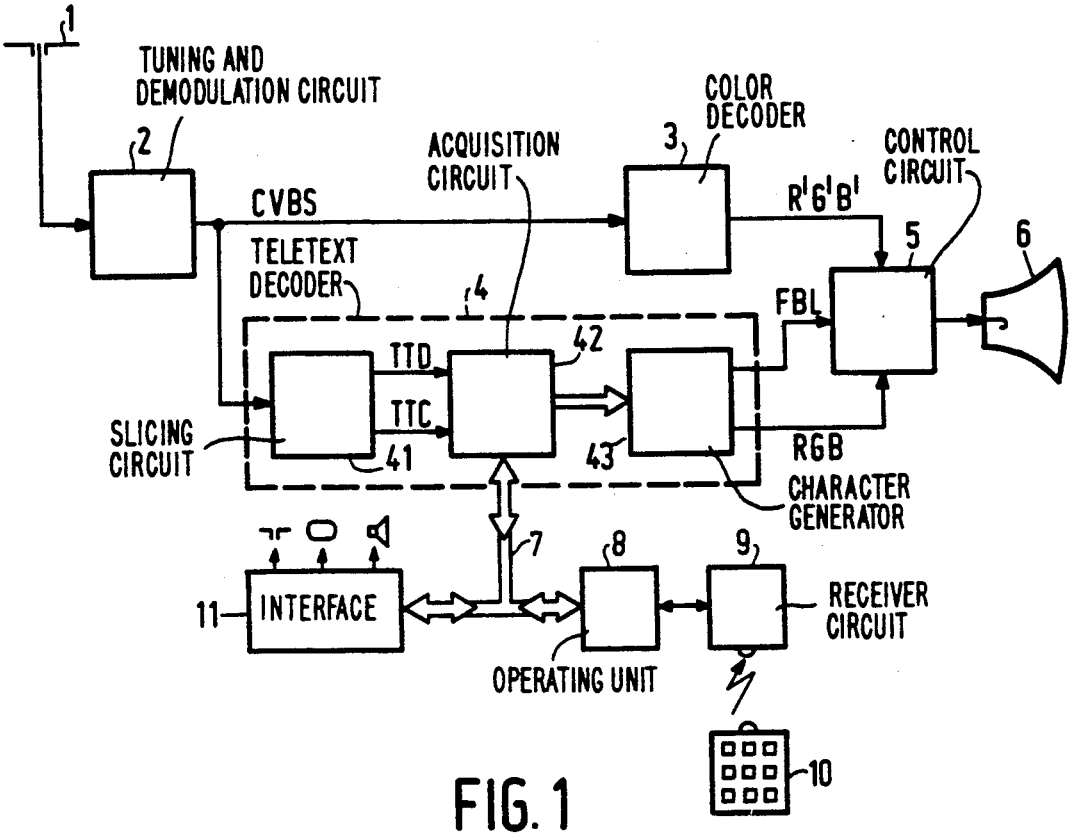

A television receiver with a teletext decoder is shown as an embodiment, with the character generator being integrated in the teletext decoder. FIG. 1 shows diagrammatically the structure of such a television receiver. The transmitter signals received at an aerial 1 are applied to a tuning and demodulation circuit 2. The obtained composite video signal CVBS of the selected television program is applied to a color decoder 3 and to a teletext decoder 4. In the normal operating condition of the receiver a picture signal R'G'B' in the form of elementary color signals generated by the color decoder 3 is applied to a display screen 6 via a first input of a control circuit 5, in order that the user can watch the received picture signal.

Teletext decoder 4 comprises a slicing circuit 41 which regenerates the digital teletext data signal TTD and the associated clock signal TTC from the applied composite video signal CVBS, an acquisition circuit 42 which can capture at least one teletext page from the teletext data signal TTD, and a character generator 43 for storing and displaying the captured teletext page. Teletext decoder 4 is also connected to an operating unit circuit 8 by means of a command bus 7. Teletext decoder 4 receives, inter alia, the number of the teletext page to be captured and displayed from operating unit 8 via command bus 7 which is in the form of, for example, a serial bus. More particularly, it is also possible to apply character information, which is generated by operating unit 8, to character generator 43 via command bus 7 and acquisition circuit 42, for example, for displaying operating menus and the like.

Character generator 43 processes the applied teletext page or operating information in a manner to be further described to a character signal RGB in the form of elementary color signals and applies this character signal to a second input of control circuit 5. Character generator 43 also generates a blanking signal FBL with which control circuit 5 is operated and with which the display of picture signal R'G'B' from color decoder 3 is blanked.

Operating instructions from the user are generated in a (remote control) operating unit 10 and applied to operating unit 8 via a receiver circuit 9. Furthermore, an interface 11 enabling operating unit 8 to tune to transmitters, control picture brightness and sound volume and the like is connected to command bus 7. This is shown by means of the appropriate symbols in the Figure.

3.3 General Structure of a Character Generator

Figure 2:
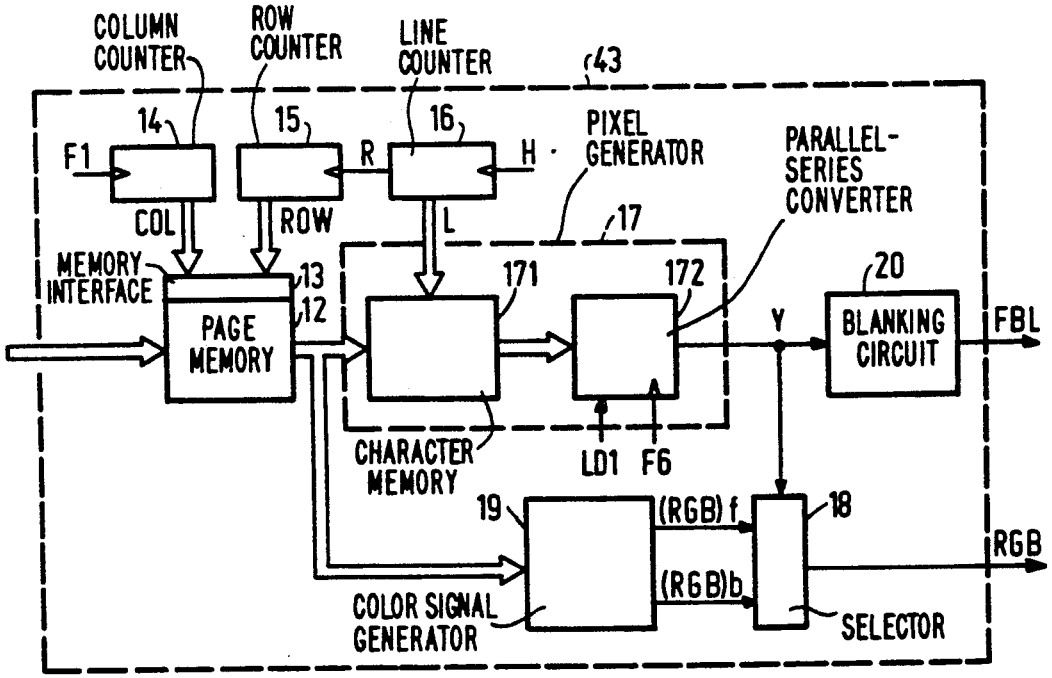
FIG. 2 PRIOR ART
FIG. 2 shows a prior-art character generator.

FIG. 2 shows the structure of a known character generator 43 which is adapted to display a page of 24 rows of 40 characters each on the display screen. The 7-bit character codes of the characters to be displayed are stored in a page memory 12. For the purpose of display, page memory 12 is addressed by a column counter 14 and a row counter 15 via a memory interface 13. Column counter 14 is controlled by a column clock signal F1 having a frequency of, for example 1 MHz so that a column number COL is generated every μsec. In order to address 40 columns in page memory 12, column number COL comprises 6 bits. Row counter 15 receives a row clock signal R from a first output of a line counter 16 which is controlled by a line clock signal H. In the TV system which is herein assumed to be a PAL system, the frequency of this line clock signal is 15625 Hz. Line counter 16 is a divide-by-10 counter so that row counter 15 generates a new row number ROW each time after 10 TV lines. In order to address 24 rows in page memory 12, row number ROW comprises 5 bits. Column numbers COL and row numbers ROW are applied to a memory interface 13 which converts the 6-bit column number and the 5-bit row number in known manner to a 10-bit memory address for successively addressing the 24*40=960 character codes in page memory 12. The character codes read from page memory 12 are successively applied to a first input of a character memory 171 which forms part of a pixel generator 17, and to a color signal generator 19.

Figure 3A:
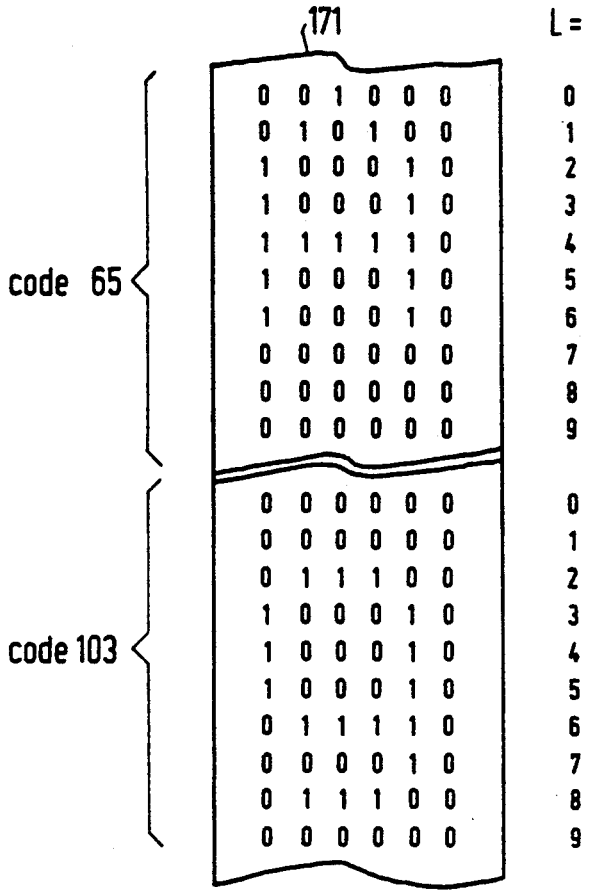
FIG.3A PRIOR ART
FIGS. 3A and 3B show examples of characters stored in a character memory.

The shape of all displayable characters is stored in a so-called dot matrix of, for example 6*10 color selection bits in character memory 171, each color selection bit representing a pixel of the character on the display screen. In this way each character is defined in terms of 10 superjacent character segments of 6 pixels. The pixels with color selection bit "1" determine the shape of the symbol to be displayed. FIG. 3A shows by way of example the dot matrix of the letter "A" which has character code 65 in practice, as well as the dot matrix of the letter "g" which has character code 103 in practice. Character memory 171 is of the read-only type so that the stored letter shapes are unchangeable. However, there are also character generators in which the color selection bits are programmable and in which the letter shapes can therefore be redefined in a dynamic manner.

A row of text comprises ten successive picture lines on the display screen. While 40 successive character codes are applied to the first input of character memory 171 during such a picture line, the line counter 16 formed as a divide-by-10 counter generates a picture line number L (L=0 . . . 9) which determines which of the ten picture lines is displayed at that moment. This picture line number L is applied to a second input of character memory 171 for addressing the character segment which corresponds to the actual picture line.

The output of character memory 171 is applied to a parallel-series converter 172 which also forms part of pixel generator 17. In this parallel-series converter 172 the 6 color selection bits of the applied character segment are parallel loaded by means of a load signal LD1 and subsequently they are serially read by means of a pixel clock signal F6. Load signal LD1 has the same frequency as the previously mentioned column clock signal F1, so that the character segment of a new character is loaded in each column clock period (1 μsec). A binary signal whose actual value corresponds to the successive color selection bits obtained from the parallel-series converter 172 now appears at the output of this parallel-series converter. This signal is further referred to as color selection signal Y. The frequency of pixel clock signal F6 is a multiple of the frequency of load signal LD1, which multiple is equal to the number of color selection bits in a character segment. In the present example pixel clock signal F6 has a frequency of 6 MHz.

Figure 3B:
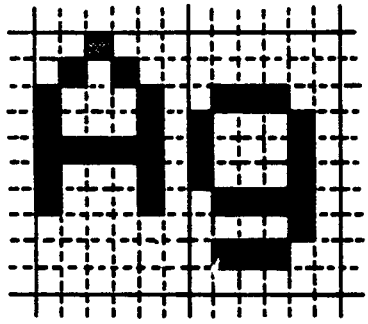
FIG.3B PRIOR ART

Color selection signal Y is applied to a selector 18, which further receives a foreground color signal $(RGB)_f$ and a background color signal $(RGB)_b$ from color signal generator 19. To this end color signal generator 19 decodes those character codes from page memory 12 which are reserved for defining character colors. If the color selection signal Y has a logic value "1", the foreground color signal will be selected in selector 18; if it is a logic "0", the background color signal will be selected. The output signal RGB of selector 18, which will be further referred to as character signal, is applied in the manner described hereinbefore to display screen 6 via the second input of control circuit 5. A blanking signal FBL, which is also supplied by the character generator and which is also applied to control circuit 5, determines whether the picture signal from color decoder 3 (FBL="0") or the character signal from character generator 43 (FBL="1") is displayed on display screen 6. FIG. 3B shows how the letters "A" and "g" are successively displayed on this display screen in the last-mentioned case. The foreground color is black and the background color is white in this Figure.

Figure 4:
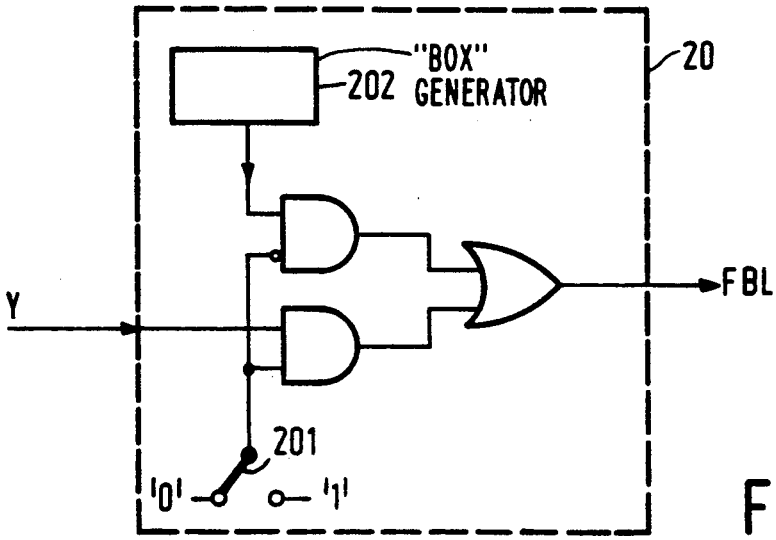
FIG.4 PRIOR ART
FIG. 4 shows a prior-art blanking circuit.
Figure 7A:
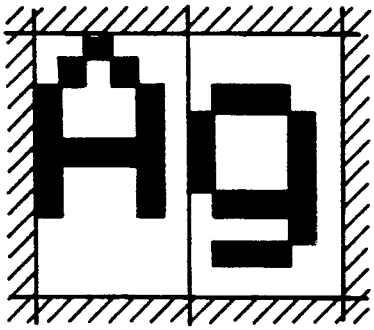
FIG.7A PRIOR ART
FIGS. 7A to 7D show examples of characters displayed on a display screen simultaneously with a video picture.
Figure 7B:
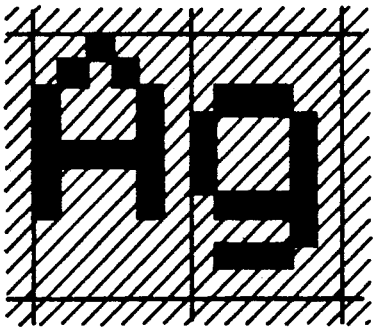
FIG.7B PRIOR ART

The blanking signal FBL is generated in a blanking circuit 20 which is formed in the way as shown in FIG. 4 for a known character generator. In a first (shown) state of a mode switch 201 the blanking signal FBL is generated by a "box" generator 202. In this so-called "boxed" mode the video picture is blanked during a predetermined "box" which comprises, for example one or more character rows or parts of rows. FIG. 7A shows its effect on a display screen. In this Figure the video picture is shaded. In a second state of switch 201 the blanking signal is generated by color selection signal Y from parallel-series converter 172. In this so-called "mixed" mode the video picture is only blanked for displaying pixels in the foreground color corresponding to color selection bit value "1". Now no pixels are displayed in the background color. FIG. 7B shows the effect of this mode on a display screen.

The drawbacks of these two methods for simultaneously displaying characters and video picture have already been mentioned in the opening paragraph: in the "boxed" mode a relatively large part of the video picture is blanked; the "mixed" mode does not provide a satisfactory readability if the foreground color and the video picture in the background have an insufficient contrast.

3.4 Embodiment of the Character Generator According to the Invention

Figure 5:
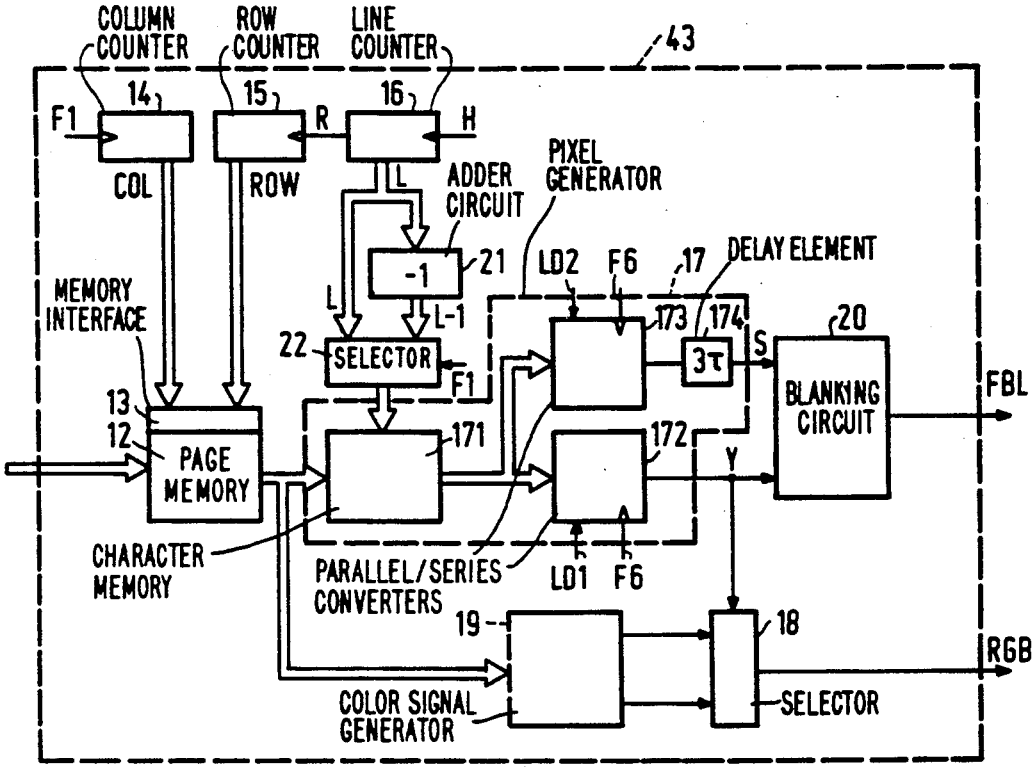
FIG. 5 shows a first embodiment of a character generator according to the invention.

FIG. 5 shows an embodiment of a character generator according to the invention. The pixel generator 17 for generating color selection bits is now adapted to generate both the color selection bits of the actual pixels and the color selection bits of predetermined adjacent pixels in response to alternately receiving the picture line number L and the load signal LD1 on the one hand and a further picture line number L−1 and a further load signal LD2 on the other hand. Picture line number L−1 is obtained by applying picture line number L of line counter 16 to an adder circuit 21. Adder circuit 21 is, for example, a combinatory network modulo-10 adding the value −1 to the picture line number L received at the input. The first picture line number L and the second picture line number L−1 are applied to a selector 22 which receives the column clock signal F1 as a selection signal. Selector 22 thereby alternately applies picture line number L−1 (in response to F1="1") and picture line number L (in response to F1 ="0") to character memory 171 during each column clock period.

A character segment comprising 6 color selection bits now appears twice per column clock period at the output of character memory 171. The character segments of character memory 171 are now also applied to a second parallel-series converter 173. Parallel loading of the 6 color selection bits in this parallel-series converter 173 is effected by means of a load signal LD2 which is phase-shifted with respect to load signal LD1. In this embodiment it has been assumed that the phase shift is 180°, which corresponds to 3 periods of pixel clock signal F6. As a result the character segment corresponding to picture line number L−1 is loaded in parallel-series converter 173 for each column clock period and 3 pixel periods later the character segment corresponding to picture line number L is loaded in parallel-series converter 172. In this respect it should be considered that L is the number of the actual picture line and L−1 is the number of the superjacent picture line.

The output of parallel-series converter 173 is delayed by three pixel periods in a delay element 174. Its output signal is then a replica of color selection signal Y delayed by exactly one line and will be referred to as shadow signal S. If the color selection signal Y has the value corresponding to that of the color selection bit of the actual pixel to be displayed, shadow signal S has the value corresponding to that of the color selection bit of the superjacent pixel.

Figure 6A:
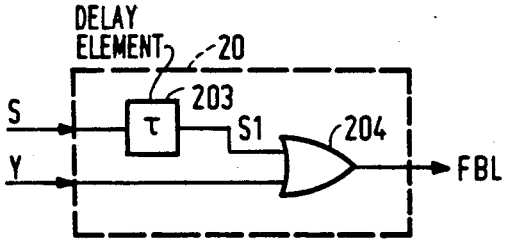
FIGS. 6A to 6C show blanking circuits for use in the character generator shown in FIG. 5.
Figure 7C:
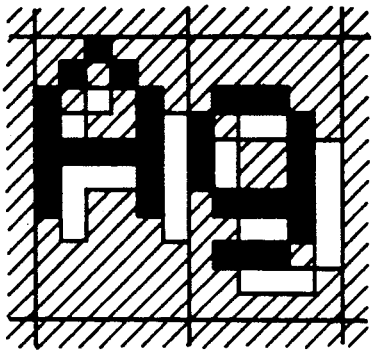

The color selection signal Y and the shadow signal S are applied to blanking circuit 20. An embodiment of this blanking circuit is shown in FIG. 6A. Shadow signal S is applied to a further delay element 203 which delays the input signal by one pixel period. The output signal of this delay element is a shadow signal S1 which is shifted one line down and one pixel to the right with respect to color selection signal Y. In other words: if the color selection signal Y has the value corresponding to that of the color selection bit of the pixel to be displayed, shadow signal S1 will have the value corresponding to that of the color selection bit of the adjacent pixel situated to the top left thereof. Shadow signal S1 and color selection signal Y are applied to an input of an OR gate 204. The output of this OR gate is the new blanking signal FBL. It blanks the video picture, not only when a pixel is displayed in the foreground color (Y="1") but also during the "shadow" of the adjacent pixel (S1="1"). While the video picture is being blanked, each pixel is displayed in the foreground or background color determined by selector 18. FIG. 7C shows the result on the display screen if the successive letters "A" and "g" are displayed simultaneously with a video picture.

Figure 6B:
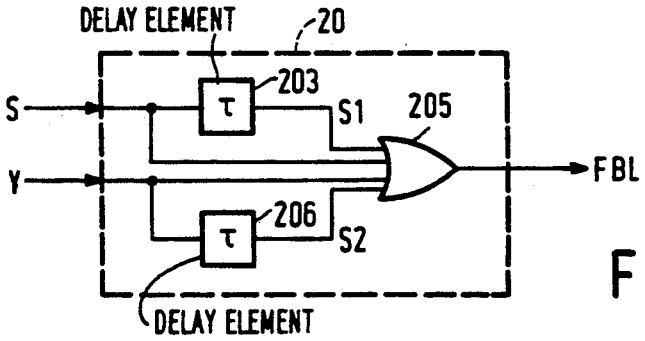
Figure 7D:
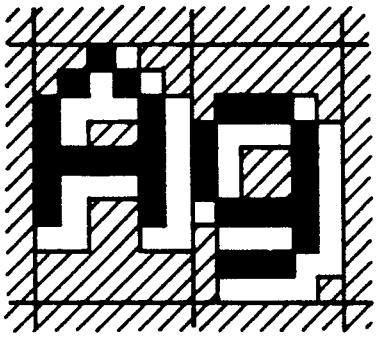

One shadow signal S1 is used in the embodiment of blanking circuit 20 shown in FIG. 6A. However, it is also possible to make blanking of the video picture depend on more than one adjacent pixel. FIG. 6B shows an embodiment of a blanking circuit 20 which can be used for this purpose. An OR gate 205 now has four inputs. The color selection signal Y is applied to a first input, which signal ensures in a manner already described that the picture signal is blanked if a pixel must be displayed in the foreground color. Shadow signal S1 is applied to a second input, which signal generates the shadow of a pixel situated to the top left in a manner which has also been described. Shadow signal S is applied to a third input. This signal generates the shadow of a superjacent pixel. Lastly, a third shadow signal S2 is applied to a fourth input of OR gate 205. This third shadow signal is obtained by delaying the color selection signal Y by one pixel period in a delay element 206 so that it generates the shadow of a pixel situated to the left. FIG. 7D shows the effect of these measures on the display screen.

Figure 6C:
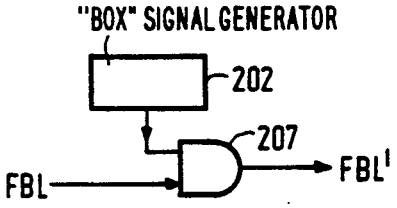

An attractive extension of the blanking circuit according to the invention is shown in FIG. 6C. The output signal FBL of the circuit shown in FIG. 6A or 6B is then applied to a first input of an AND gate 207, whose second input receives the "box" signal from the "box" signal generator 202 previously described (FIG. 4). By applying output signal FBL' of this AND gate as a blanking signal to control circuit 5, the video picture is only blanked within a predetermined "box". This embodiment is attractive because teletext subtitles, which the TV editor always places in a "box" at the transmitter end, are now displayed while maintaining a maximum possible quantity of video picture, while the functional character of foreground and background colors, which is often essential in this application, is fully maintained.

In the embodiment of a character generator according to the invention shown in FIG. 5 the following should be considered: while the upper segment (corresponding to picture line number L=0) of a character is being displayed, the modulo-10 operation in adder circuit 21 causes the shadow signal to be obtained from the lower segment of the same character. To prevent the shadow of the lower side from being displayed at the upper side of a character, the lower character segment may only have logic values "0". This is generally complied with, because the lower character segment of a character also provides the required line spacing. However, this is not the case when displaying graphic symbols which are conventional in teletext decoders. They extend throughout the character matrix and may be displayed contiguously.

Figure 8:
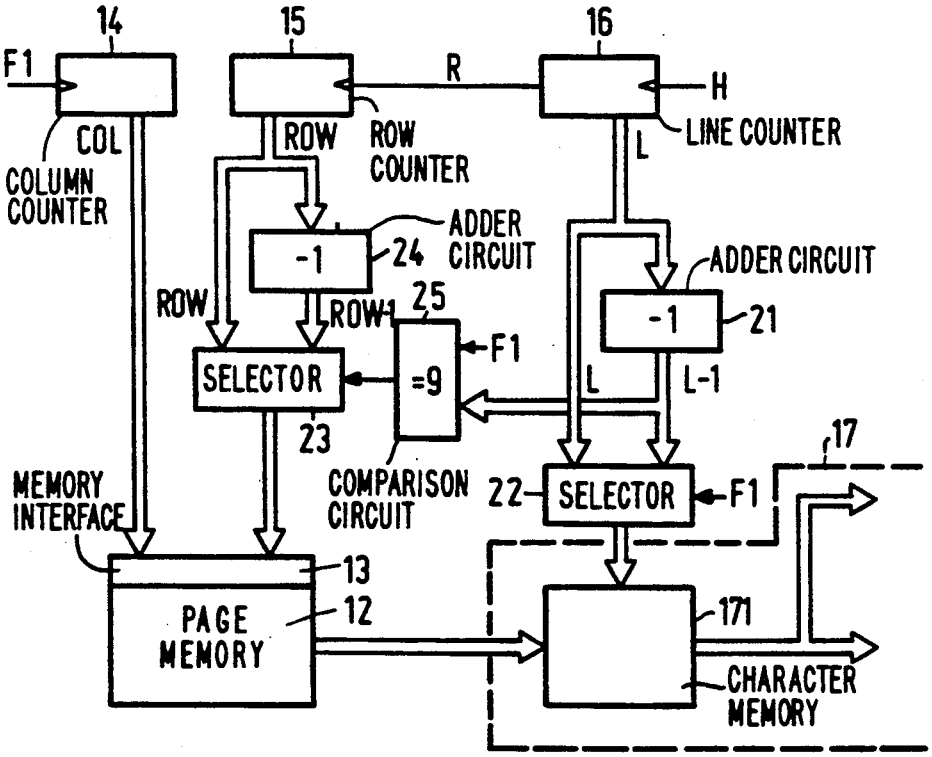
FIG. 8 shows a second embodiment of a character generator according to the invention.

FIG. 8 shows an embodiment of a possible addressing of page memory 12 and character memory 171 which also generates a correct shadow under these circumstances. The input of memory interface 13 to which the row number is applied is now coupled to the output of row counter 15 via a selector 23 and an adder circuit 24. Adder circuit 24 receives the row number ROW and generates a row number ROW−1, for example, by adding the value −1 to the row number applied to the input. Selector 23 is controlled by a selection signal which is generated in a comparison circuit 25 in such a way that row number ROW−1 is selected if the lower character segment of the character is addressed (L−1=9) in character memory 171 for the purpose of generating shadow signal S. It is achieved thereby that the shadow signal S is obtained from the lower character segment of the superjacent character while the upper character segment of the actual character is being displayed.

Furthermore, it is to be noted that shadows can be generated in more variations. For example, a character may be provided with a shadow at its lower side as well as at its upper side. In this case not only the superjacent character segment is addressed, as described hereinbefore, for generating the required shadow signals while the pixels of a character segment are being displayed, but also the subjacent character segment is addressed. The shadow of a pixel may also be more than one pixel wide and more than one picture line high. Embodiments thereof are not described in detail because they are elaborations of the above-described embodiments which can be implemented by those skilled in the art on the basis of the foregoing description.

Figure 5A:
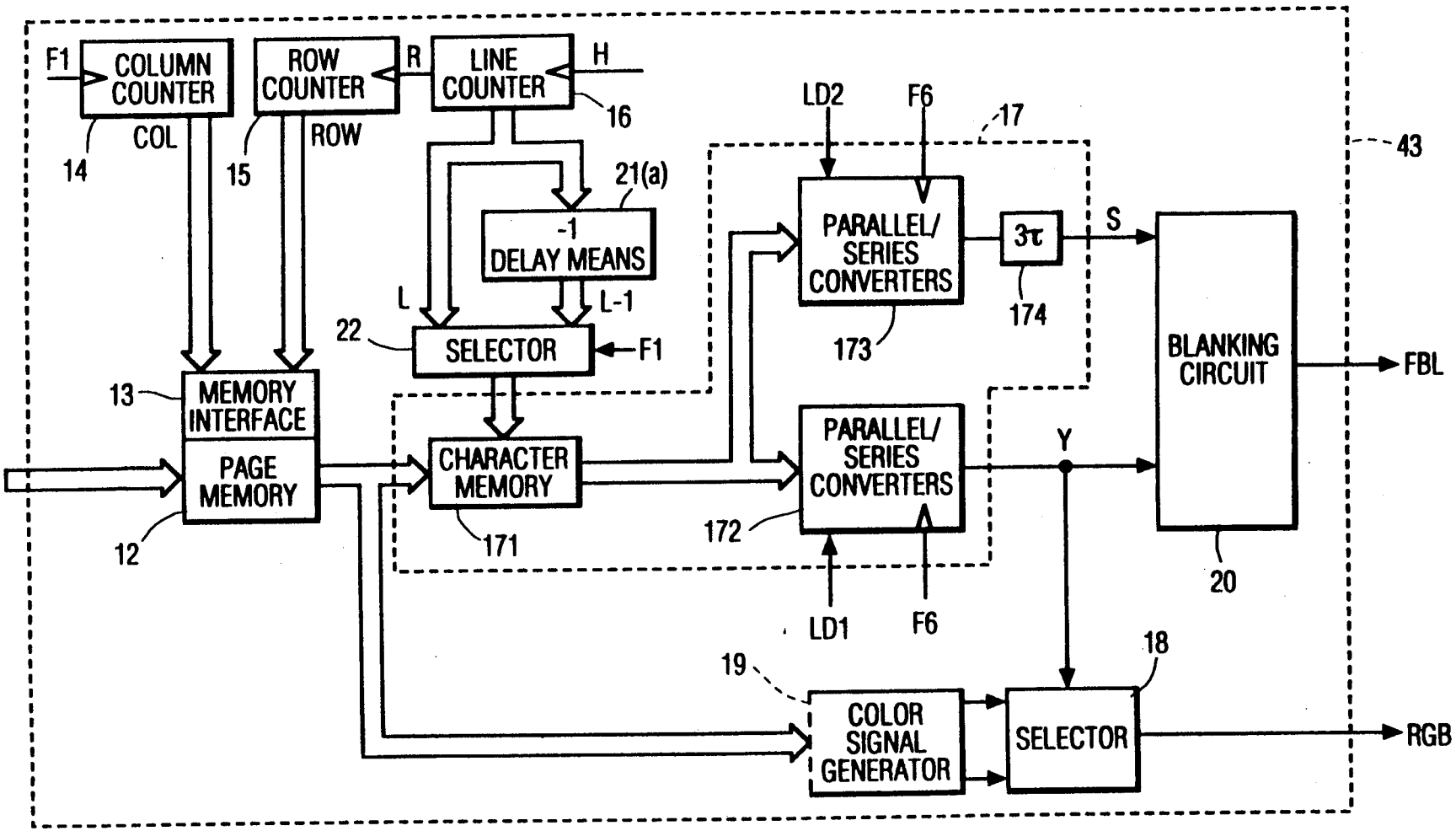
FIG. 5A shows a variation of the embodiment shown in FIG. 5.
Figure 9:
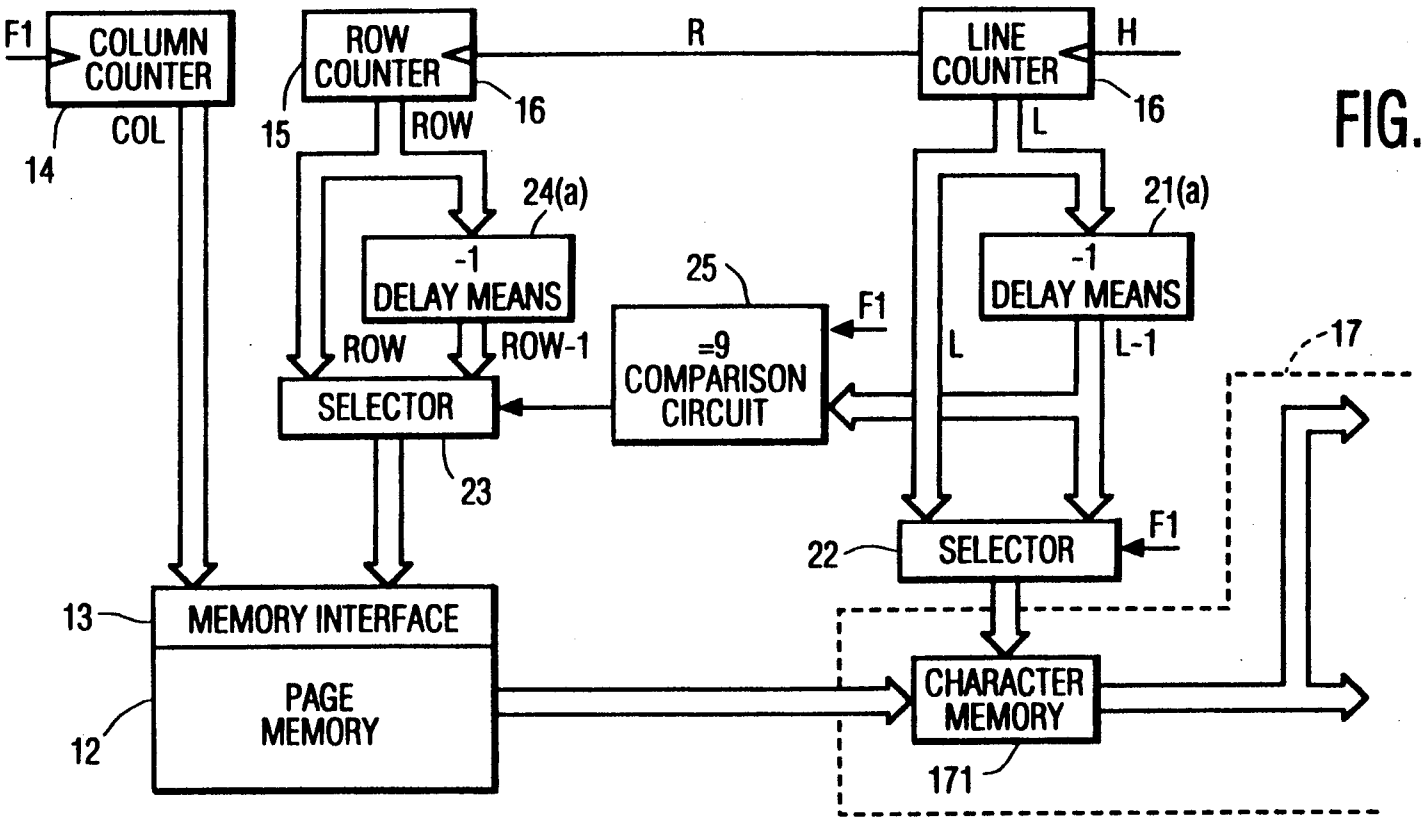
FIG. 9 shows a third embodiment of a character generator according to the invention.

Finally, it should be noted that some functions can be realized in a different manner than has been described with reference to the embodiments. As shown in FIGS. 5A and 9 for example, the adder circuit 21 in FIGS. 5 and 8 may be replaced by a delay element 21(a) with which picture line number L−1 is obtained by delaying the picture line number L applied to the input by one TV line. Identically, the adder circuit 24 of FIG. 8 may be replaced by a delay element 24(a), as shown in FIG. 9, generating row number ROW−1 by delaying the applied row number ROW by 10 TV lines by means of row clock signal R.

I claim:

1. A character generator for generating characters comprising n*m pixels, where n and m are integers, on a display screen which is also adapted to display a picture signal, said character generator comprising:

a) means for generating a character code corresponding to a character to be displayed;

b) pixel generating means for generating color selection bits in response to said character code and a pixel address;

c) pixel addressing means for alternately generating and providing to said pixel generating means a first pixel address so as to obtain a first color selection bit for a first pixel to be displayed and a second pixel address so as to obtain a second color selection bit for a predetermined pixel adjacent to said first pixel;

d) color generating means for generating a foreground color for said first pixel in response to a first value of said first color selection bit and a background color for said first pixel in response to a second value of said first color selection bit, and for generating a foreground color for said predetermined pixel in response to a first value of said second color selection bit and a background color for said predetermined pixel in response to a second value of said second color selection bit; and e) a blanking circuit for providing a blanking signal for blanking said picture signal which is:

i. active when said first pixel has said foreground color;

ii. active when said first pixel has said background color and said predetermined pixel has said foreground color; and iii. inactive when said first pixel has said background color and said predetermined pixel has said background color.

2. A character generator as claimed in claim 1, wherein the pixel addressing signal comprises first and second pixel addressing signals and wherein the second pixel addressing signal is obtained by adding a predetermined value to the first pixel addressing signal.

3. A character generator as claimed in claim 1, wherein said pixel addressing signal comprises first and second pixel addressing signals each comprising a picture line number for simultaneously addressing a predetermined number of color selection bits to be successively generated, the picture line number of the second pixel addressing signal being obtained by adding a predetermined value to the picture line number of the first pixel addressing signal.

4. A character generator as claimed in claim 1, wherein said pixel addressing signal comprises first and second pixel addressing signals which each comprise a picture line number for simultaneously addressing a predetermined number of color selection bits to be successively generated, the picture line number of the second pixel addressing signal being obtained by delaying the picture line number of the first pixel addressing signal at least once by a period which corresponds to the display of a picture line on the display screen.

5. A character generator as claimed in claim 1, in which the means for generating character codes of the characters to be displayed comprise a page memory for receiving, storing and reading said character codes in response to an applied address, wherein the address of the character code of a predetermined adjacent character is applied to said page memory while said pixel addressing signal is applied to the pixel generator.

6. A character generator as claimed in claim 5, wherein the address of the character code of the predetermined adjacent character is obtained by adding a predetermined value to the address of the character code of a selected character to be displayed.

7. A character generator as claimed in claim 5, in which the address applied to the page memory comprises, a row number, wherein the row number of the address of the character code of the predetermined adjacent character is obtained by adding a predetermined value to the row number of the address of the character code of a selected character to be displayed.

8. A character generator as claimed in claim 5, in which the address applied to the page memory comprises, a row number, wherein the row number of the address of the character code of the predetermined adjacent character is obtained by delaying the row number of the address of the character code of a selected character to be displayed, at least once by a period which corresponds to the display of a row of characters on the display screen.

9. A character generator as claimed in claim 1, which further comprises means for generating a "box" signal which indicates which characters are to be displayed, wherein the blanking signal is only generated during the occurrence of the "box" signal.

10. A character generator as claimed in claim 2, in which the means for generating character codes of the characters to be displayed comprise a page memory for receiving, storing and reading said character codes in response to an applied address, wherein the address of the character code of a predetermined adjacent character is applied to said page memory while said second pixel addressing signal is applied to the pixel generator.

11. A television receiver comprising the character generator as claimed in claim 1.

* * * * *